US005816792A

United States Patent [19]

Spencer

[11] Patent Number: 5,816,792

[45] Date of Patent: Oct. 6, 1998

[54] ALTERNATE GAS FUEL BURNING SYSTEM

[75] Inventor: Bryan W. Spencer, Fort Erie, Canada

[73] Assignee: Roberts-Gordon, Inc., Buffalo, N.Y.

[21] Appl. No.: 995,621

[22] Filed: Dec. 22, 1997

[51] Int. Cl.[6] ..... G05D 11/00

[52] U.S. Cl. ..... 431/90; 137/113

[58] Field of Search ..... 431/90; 137/113

[56] References Cited

U.S. PATENT DOCUMENTS

| | | | |
|---|---|---|---|
| 2,168,701 | 8/1939 | Buttner | 137/113 |
| 3,001,541 | 9/1961 | St. Clair | 137/113 |

*Primary Examiner*—Carroll B. Dority
*Attorney, Agent, or Firm*—Bean, Kauffman & Snyder

[57] ABSTRACT

A fuel burning system comprises a burner in communication with a burner supply pipe having an automatic two-stage regulator valve for controlling the pressure of fuel gas delivered to the burner. The burner supply pipe is normally fed by a primary supply pipe delivering collected digester or landfill gas through an automatic three-way valve, however a secondary supply pipe carrying natural gas may be selected by the three-way valve for communication with the burner supply pipe. The regulator valve and three-way valve are electrically connected to a standard ignition module by a pressure-sensitive switch to detect the presence of digester or landfill gas in the primary supply pipe. When sufficient gas pressure exists in the primary supply pipe, the three-way valve is operated to permit delivery of the digester or landfill gas to the burner supply pipe and the regulator valve is held in its high stage setting for burning this primary fuel. When sufficient gas pressure is not present in the primary supply pipe, the three-way valve enables communication of natural gas between the secondary supply pipe and the burner supply pipe, and the regulator valve is held in its low stage setting for burning this secondary fuel. An alternative embodiment is disclosed wherein the three-way valve is replaced by a pair of automatic gas valves in the primary and secondary supply pipes, respectively.

7 Claims, 2 Drawing Sheets

ALTERNATE GAS FUEL BURNING SYSTEM

BACKGROUND

A. Field of the Invention

The present invention relates generally to the field of fuel burning systems for space and process heating, and more particularly to systems for burning methane gas produced as a byproduct of anaerobic decomposition of organic materials.

B. Description of the Prior Art

In many sewage treatment plants which utilize a waste activated sludge process, the sewage is treated in large anaerobic reactors commonly known as "digesters". The gaseous respiratory products of bacteria, primarily methane and carbon dioxide, collect within the respective top portions of the reactors. It is known to use the collected gas, referred to as "digester gas", to fire boilers which provide process heat for the digesters and also space heat for occupied buildings at the treatment plant. Digesters must be maintained at 98° F. to ensure the growth of the organisms responsible for the anaerobic digestion process. Therefore, process heat is transferred to the digesters through heat exchangers having heated water on a primary side thereof and digester sludge on a secondary side thereof. Since sewage treatment plants are typically made up of several buildings separated by open tanks and channels containing sewage at various stages of treatment, using steam or hot water for space heating requires long runs of supply and return piping which often must be run underground. Moreover, many of these buildings are large with high ceilings, and are occupied intermittently. Using boilers for both process and space heat in a sewage treatment plant also indicates the production of water at two different operating temperatures. The thermal transfer of process heat to the digesters indicates an operating temperature of less than 120° F. to prevent "baking" of the sludge onto the transfer surface of the secondary side of the heat exchangers. However, the operating temperature indicated for space heating is about 180° F. Consequently, additional heat exchangers are necessary to accommodate for the two different operating conditions.

Despite these problems, boilers continue to be used extensively at sewage treatment plants because the benefits of a free fuel source for process heat overcome the added cost and complexities of the hydronic or steam systems. Nevertheless, if an alternate system of utilizing the digester gas for space heating fuel were available, the boilers could be dedicated solely to process heating. As a result, smaller and less expensive boilers could be operated at the optimum temperature for heating the digester sludge.

The same bacteria found in anaerobic digesters act on buried organic materials in the oxygen poor environment of a landfill site, producing a byproduct known as "landfill gas". Landfill gas is collected by a buried grid of perforated pipes, and is almost invariably burned as waste gas because there is no process at a landfill site which can readily use the steam or hot water produced by boilers. However, if an alternate system utilizing digester gas for space heating fuel were available, as mentioned above in connection with sewage treatment plants, it could also be installed at a landfill site for heating service buildings and the like using landfill gas.

Ideally, an alternate system fueled by digester or landfill gas should be capable of burning a backup fuel, such as natural gas, which is readily available from a secondary source independent of the digester or landfill gas collection and distribution system. In this way, interruption in the collection and/or distribution of digester or landfill gas will not cause an interruption in space heating at the facility.

SUMMARY OF THE INVENTION

Therefore, it is an object of the present invention to provide a fuel burning system for burning either a primary fuel, such as digester gas or landfill gas, or a secondary fuel having a different calorific value, such as natural gas, using the same burner and burner controls.

It is another object of the present invention to provide a fuel burning system which automatically switches between a primary fuel and a secondary fuel depending upon the availability of the primary fuel.

In view of these and other objects, a fuel burning system of the present invention comprises a burner in communication with a burner supply pipe having an automatic two-stage regulator valve installed therealong for controlling the pressure of fuel gas delivered to the burner. The burner supply pipe is normally fed by a primary supply pipe delivering collected digester or landfill gas to the burner supply pipe via automatic valve means, however a secondary supply pipe carrying natural gas may be selected by the automatic valve means for communication with the burner supply pipe. The regulator valve and automatic valve means are electrically connected to a standard ignition module by a pressure-sensitive switch installed to detect the presence of digester or landfill gas in the primary supply pipe. When sufficient gas pressure exists in the primary supply pipe, the automatic valve means is operated to permit delivery of the digester or landfill gas to the burner supply pipe and the regulator valve is held in its high stage setting as indicated for burning this primary fuel. When sufficient gas pressure is not present in the primary supply pipe, the automatic valve means favors communication of natural gas between the secondary supply pipe and the burner supply pipe, and the regulator valve is held in its low stage setting as indicated for burning this secondary fuel.

BRIEF DESCRIPTION OF THE DRAWINGS

The nature and mode of operation of the present invention will now be more fully described in the following detailed description of the preferred embodiments taken with the accompanying drawing figures, in which.

DETAILED DESCRIPTION OF THE PREFERRED EMBODIMENTS

Figure 1:
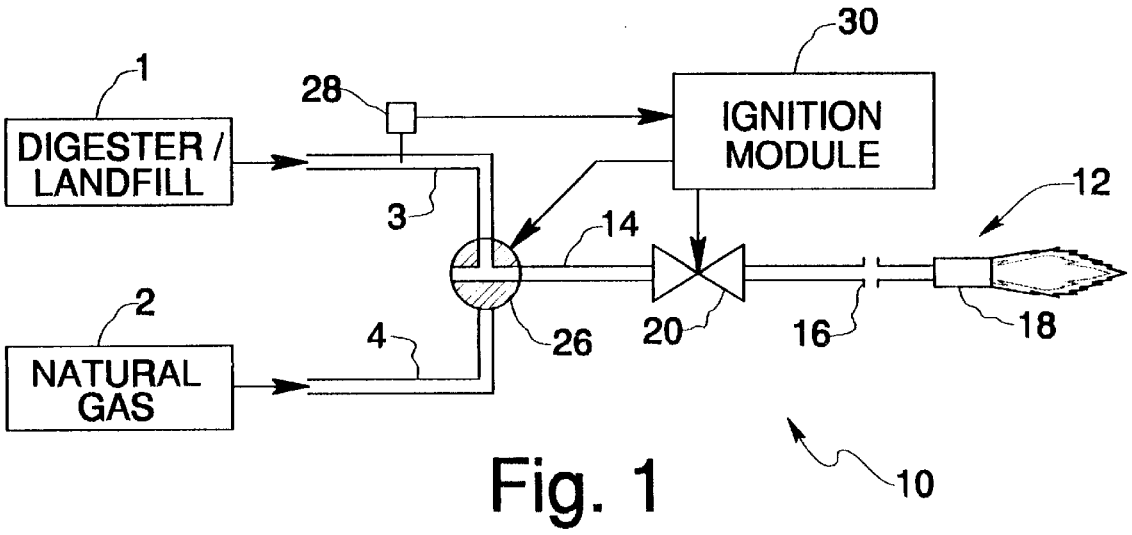
FIG. 1 is a schematic diagram of a fuel burning system formed in accordance with a preferred embodiment of the present invention.

Referring initially to FIG. 1 of the drawings, a fuel burning system formed in accordance with a preferred embodiment of the present invention is shown schematically and identified generally by the reference numeral 10. Fuel burning system 10 is conventional in that it includes a burner 12 which is fed with fuel gas by way of a burner supply pipe 14 in flow communication with a burner orifice 16 and burner cup 18. In accordance with the present invention, fuel burning system 10 is designed to switch automatically between a primary fuel source 1, preferably collected digester gas or landfill gas, and a secondary fuel source 2, preferably natural gas from a utility gas line, depending upon whether sufficient supply of the primary fuel is available.

Figure 2:
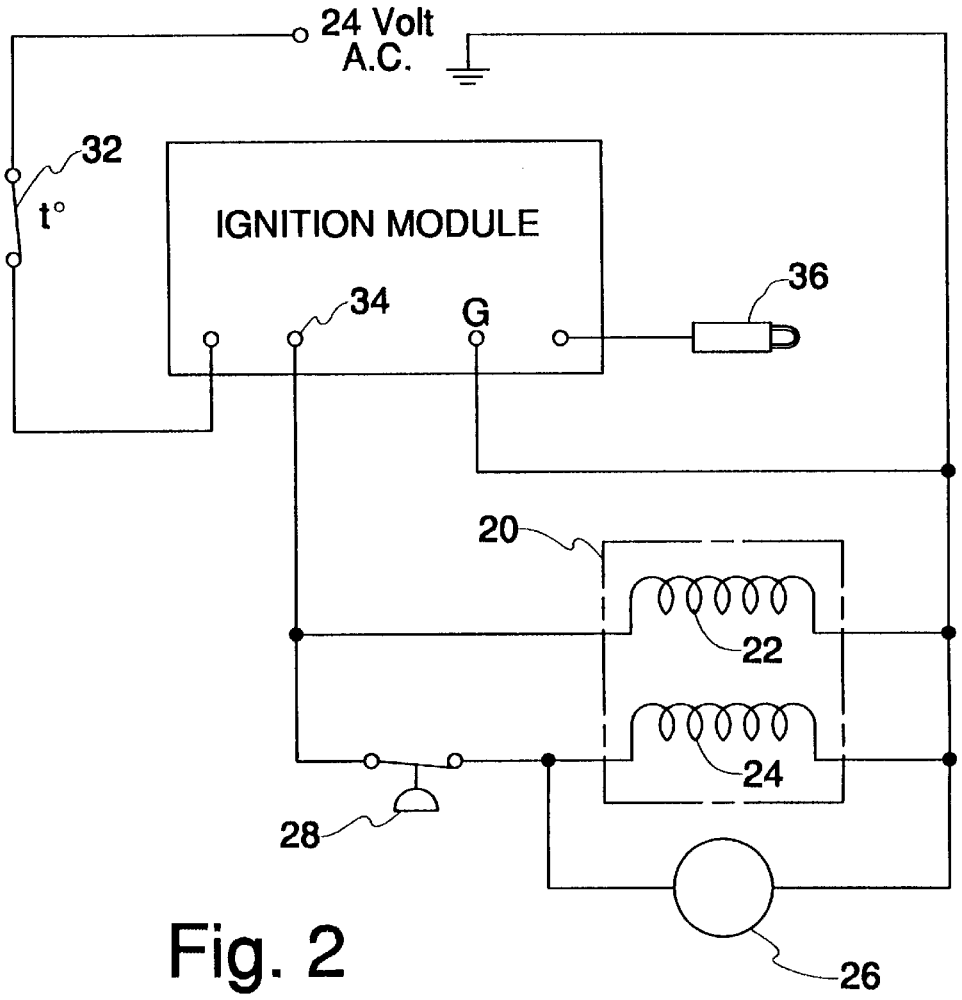
FIG. 2 is a schematic wiring diagram of the fuel burning system of FIG. 1.

Referring also now to FIG. 2, a two-stage regulator valve 20 is installed along burner supply pipe 14 upstream of burner 12. Regulator valve 20 internally includes a low stage solenoid 22 and a high stage solenoid 24 for automatically controlling the pressure of fuel gas delivered to burner 12. When regulator valve 20 is in its high stage setting, namely when both low stage solenoid 22 and high stage solenoid 24 are energized, fuel gas is supplied to burner 12 at a first pressure; when regulator valve 20 is in its low stage setting, namely when only low stage solenoid 22 is energized, fuel gas is supplied to burner 12 at a second pressure less than the first pressure associated with the high stage setting. A suitable automatic regulator valve for use in practicing the present invention is manufactured by White-Rodgers under Part No. 36E96. The high stage setting of regulator valve 20 is used to regulate the pressure of digester or landfill gas, which has a lower calorific value than natural gas, from 11 inches water column to 10 inches water column; the low stage setting of regulator valve 20 is used to regulate the pressure of natural gas from 7 inches water column to 3 inches water column.

Burner supply pipe 14 is fed either by primary supply pipe 3 delivering digester or landfill gas from primary fuel source 1, or by secondary supply pipe 4 delivering natural gas from secondary fuel source 2. An automatic three-way valve 26 is provided at the junction of primary supply pipe 3, secondary supply pipe 4, and burner supply pipe 14 for enabling a selected one of supply pipes 3,4 to communicate with burner supply pipe 14 while excluding the other of supply pipes 3,4 from communication with the burner supply pipe. A three-way valve manufactured by ASCO under Part No. 8300D68RU is of a type which will perform this function. In the presently described embodiments, automatic three-way valve 26 is installed such that when its solenoid is not energized, it selects secondary supply pipe 4 for exclusive communication with burner supply pipe 14.

A pressure-sensitive switch 28 is installed along primary supply pipe 3 for detecting whether or not gas pressure within the primary supply pipe is above a predetermined threshold pressure, preferably 10 inches water column. A Honeywell gas switch Part No. C637B, or similar type gas switch, is suitable.

A single flame-sensing ignition module 30, connected in a known manner across an 24 Volt A.C. power source by way of a thermostat switch 32, provides control functions for the system. As may be seen in FIG. 2, low stage solenoid 22 of regulator valve 20 is electrically connected between the valve control terminal 34 of ignition module 30 and ground, and remains energized regardless of whether pressure-sensitive switch 28 is open or closed. High stage solenoid 24 and three-way valve 26 are electrically connected between valve control terminal 34 and ground by way of pressure-sensitive switch 28. A flame sensor 36 is also shown as being connected to ignition module 30.

System operation of the preferred embodiment is now described in conjunction with FIGS. 1 and 2. When thermostat switch 32 closes due to falling temperature, the ignition module 30 is activated and the low stage solenoid 22 of regulator valve 20 is energized. If the pressure of digester or landfill gas in primary supply pipe 3 is above the threshold pressure, pressure-sensitive switch 28 is closed such that high stage solenoid 24 and three-way valve 26 are energized along with low stage solenoid 22. Under these conditions, primary supply pipe 3 is selected for communication with burner supply pipe 14 by energized three-way valve 26, thereby allowing fuel from primary fuel source 1 to flow through regulator valve 20 electrically held at its high stage setting. Accordingly, digester or landfill gas undergoes combustion at burner 12.

If the pressure of digester or landfill gas within primary supply pipe 3 is not above the threshold pressure required to maintain pressure-sensitive switch 28 in its closed state, the pressure-sensitive switch opens to electrically disconnect high stage solenoid 24 and three-way valve 26. As mentioned above, when the solenoid of three-way valve 26 is not energized, secondary supply pipe 4 communicates with burner supply pipe 14 to the exclusion of primary supply pipe 3. Consequently, natural gas from secondary source 2 will flow through regulator valve 20 set at its low stage to deliver natural gas for combustion at burner 12. If gas pressure within primary supply pipe 3 increases sufficiently to close pressure-sensitive switch 28, the system will automatically switch over to the primary fuel as described above. The system will of course shut down upon opening of thermostat switch 32 incident to rising temperature.

Figure 3:
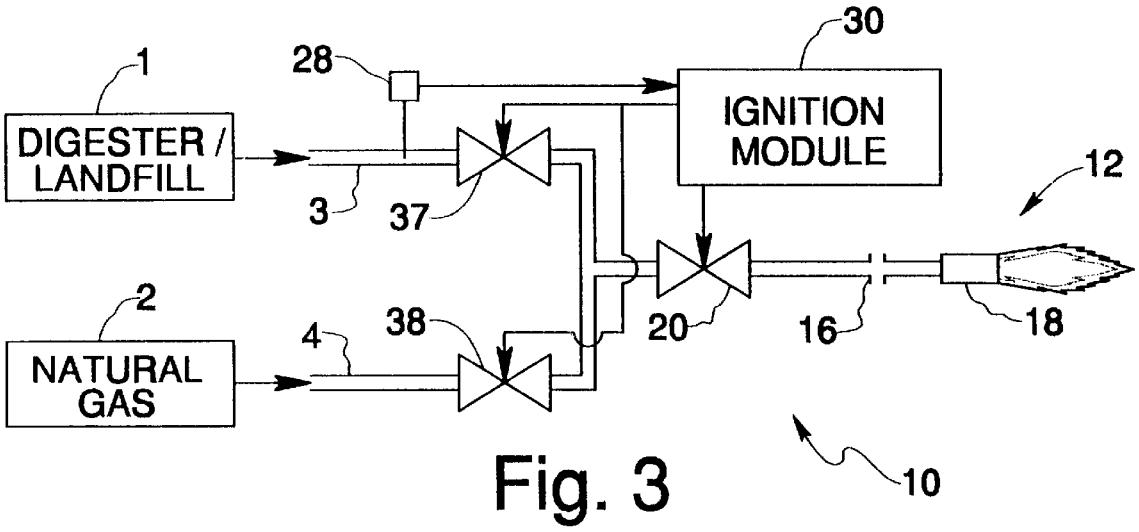
FIG. 3 is a schematic diagram of a fuel burning system formed in accordance with an alternative embodiment of the present invention.
Figure 4:
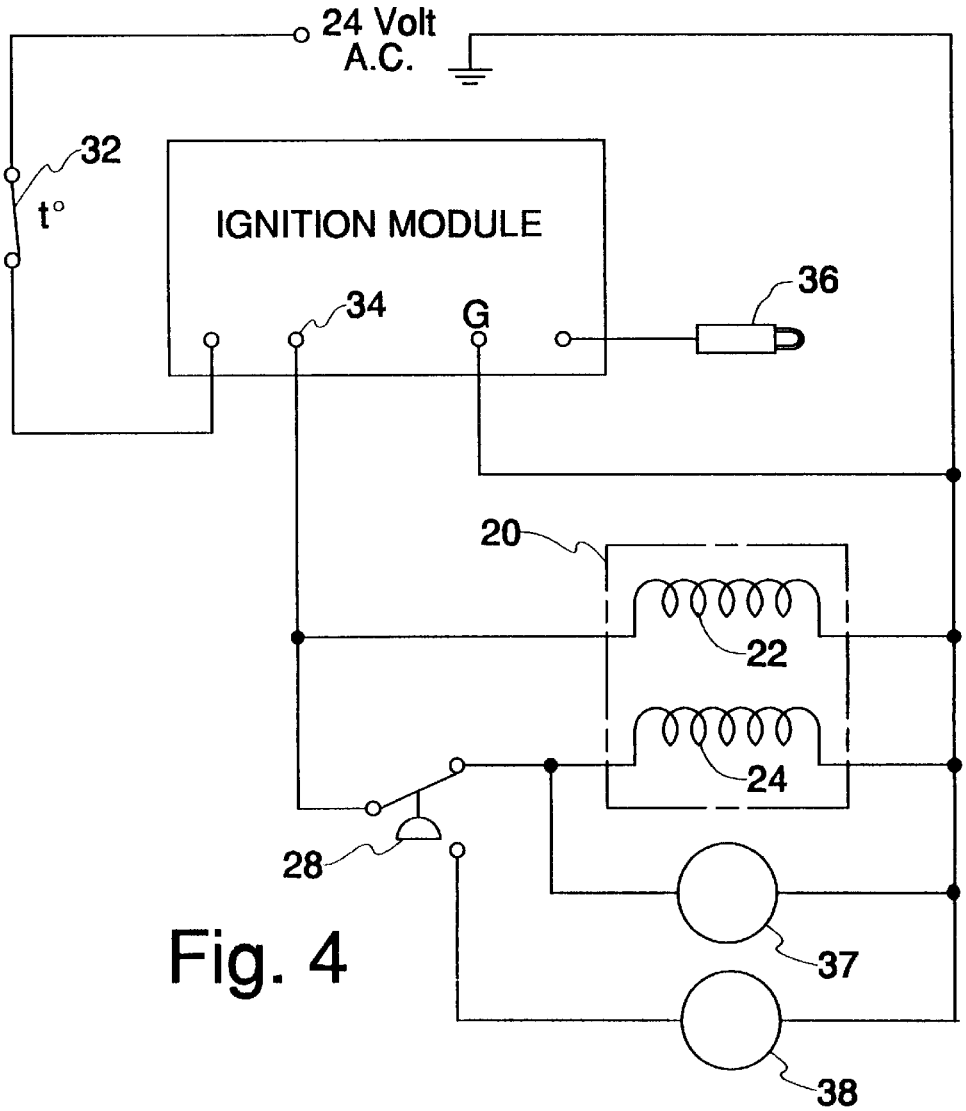
FIG. 4 is a schematic wiring diagram of the fuel burning system of FIG. 3.

An alternate embodiment of the present invention is shown in FIGS. 3 and 4. The alternate embodiment is identical to the preferred embodiment, except that a pair of automatic gas valves 37 and 38 are used in place of three-way valve 26. Gas valve 37 is installed along primary supply pipe 3 to control the flow of fuel from primary fuel source 1, while gas valve 38 is installed along secondary supply pipe 4 to control the flow of fuel from secondary fuel source 2. As may be seen from FIG. 4, pressure-sensitive switch 28 electrically connects high stage solenoid 24 and gas valve 37, and electrically disconnects gas valve 38, when sufficient gas pressure exists within primary supply pipe 3. This enables flow communication between primary supply pipe 3 and burner supply pipe 14, and holds regulator valve 20 in its high stage setting, as required for burning landfill or digester gas. When gas pressure within primary supply pipe 3 is not above the threshold pressure necessary for burning digester or landfill gas from primary fuel source 1, pressure-sensitive switch 28 electrically disconnects high stage solenoid 24 and gas valve 37, and electrically connects gas valve 38, thereby opening flow communication between secondary supply pipe 4 and burner supply pipe 14 and placing regulator valve 20 in its low stage setting for burning natural gas from secondary fuel source 2.

What is claimed is:

1. A fuel burning system comprising:

a burner;

a burner supply pipe delivering fuel to said burner;

a primary supply pipe connected to said burner supply pipe for delivering fuel from a primary fuel source;

a secondary supply pipe connected to said burner supply pipe for delivering fuel from a secondary fuel source;

pressure sensing means installed along said primary supply pipe for detecting a primary fuel pressure in said primary supply pipe;

automatic valve means for selecting between said primary and secondary supply pipes for exclusive communication with said burner supply pipe, said automatic valve means being operably connected to said pressure sensing means for choosing said primary supply pipe for exclusive communication with said burner supply pipe when said primary fuel pressure is above a threshold pressure, and for choosing said secondary supply pipe for exclusive communication with said burner supply pipe when said primary fuel pressure is not above said threshold pressure; and an automatic regulator valve installed along said burner supply pipe upstream of said burner for regulating fuel flow within said burner supply pipe, said regulator valve having a high stage setting for delivering fuel to said burner at a first pressure and a low stage setting for delivering fuel to said burner at a second pressure, said regulator valve being operably connected to said pressure sensing means for choosing said high stage setting when said primary fuel pressure is above said threshold pressure, and for choosing said low stage setting when said primary fuel pressure is not above said threshold pressure.

2. The fuel burning system according to claim 1, wherein said fuel from said primary fuel source is digester gas.

3. The fuel burning system according to claim 1, wherein said fuel from said primary fuel source is landfill gas.

4. The fuel burning system according to claim 1, wherein said fuel from said secondary fuel source is natural gas.

5. The fuel burning system according to claim 1, wherein said automatic valve means comprises a three-way valve connecting said primary and secondary supply pipes to said burner supply pipe for selective communication therewith.

6. The fuel burning system according to claim 1, wherein said automatic valve means comprises a pair of automatic gas valves installed one along each of said primary and secondary supply pipes, each of said pair of gas valves being operably connected to said pressure sensing means.

7. The fuel burning system according to claim 1, wherein said pressure sensing means is a pressure sensitive switch.

* * * * *